US005565308A

United States Patent [19]

Carli et al.

[11] Patent Number: 5,565,308

[45] Date of Patent: Oct. 15, 1996

[54] METHOD OF PROCESSING BLACK AND WHITE PHOTOGRAPHIC ELEMENTS USING PROCESSORS HAVING LOW VOLUME THIN TANK DESIGNS

[75] Inventors: Jerel R. Carli, Penfield; David G. Foster, West Henrietta; Edgar P. Gates, Honeoye; David L. Patton, Webster; John H. Rosenburgh, Hilton; Sheridan E. Vincent, Rochester, all of N.Y.

[73] Assignee: Eastman Kodak Company, Rochester, N.Y.

[21] Appl. No.: 419,217

[22] Filed: Apr. 10, 1995

Related U.S. Application Data

[63] Continuation-in-part of Ser. No. 221,711, Mar. 31, 1994, Pat. No. 5,436,118.

[51] Int. Cl.[6] ..... G03C 5/38; G03C 5/18; G03C 5/26; G03C 5/00

[52] U.S. Cl. ..... 430/400; 430/30; 430/399; 430/403; 430/450; 430/963; 396/626; 396/627; 396/641

[58] Field of Search ..... 430/30, 398, 399, 430/400, 401, 403, 450, 963; 354/322, 324, 325, 331, 336

[56] References Cited

U.S. PATENT DOCUMENTS

| | | | |
|---|---|---|---|
| 2,401,185 | 5/1946 | Pratt et al. | 354/375 |
| 2,993,427 | 7/1961 | Lovercheck | 354/331 |
| 4,245,034 | 1/1981 | Libicky et al. | 430/399 |
| 4,328,306 | 5/1982 | Idota et al. | 430/393 |
| 4,613,562 | 9/1986 | Kuse et al. | 430/450 |
| 4,786,584 | 11/1988 | Endo | 430/434 |
| 4,791,048 | 12/1988 | Hirai et al. | 430/372 |
| 4,797,351 | 1/1989 | Ishikawa et al. | 430/387 |
| 4,977,067 | 12/1990 | Yoshikawa et al. | 430/398 |
| 4,997,749 | 3/1991 | Wernicke et al. | 430/464 |
| 5,004,676 | 4/1991 | Meckl et al. | 430/398 |
| 5,024,924 | 6/1991 | Deguchi | 430/379 |
| 5,043,756 | 8/1991 | Takabayashi et al. | 354/331 |
| 5,077,180 | 12/1991 | Christ et al. | 34/32 |
| 5,179,404 | 1/1993 | Bartell et al. | 354/320 |
| 5,243,373 | 9/1993 | Glover et al. | 354/331 |
| 5,252,439 | 10/1993 | Nakamura | 430/399 |
| 5,270,762 | 12/1993 | Rosenburgh et al. | 354/324 |
| 5,294,596 | 3/1994 | Earle | 354/324 |
| 5,302,996 | 4/1994 | Hall et al. | 354/336 |
| 5,311,235 | 5/1994 | Piccinino et al. | 354/336 |
| 5,347,337 | 9/1994 | Patton et al. | 354/336 |
| 5,353,082 | 10/1994 | Rosenburgh et al. | 354/331 |
| 5,353,083 | 10/1994 | Rosenburgh et al. | 354/331 |
| 5,353,086 | 10/1994 | Piccinino et al. | 354/336 |
| 5,353,087 | 10/1994 | Rosenburgh et al. | 354/336 |
| 5,353,088 | 10/1994 | Rosenburgh et al. | 354/336 |
| 5,355,190 | 10/1994 | Rosenburgh et al. | 354/325 |
| 5,357,307 | 10/1994 | Glanville et al. | 354/336 |
| 5,361,114 | 11/1994 | Earle | 354/336 |
| 5,400,106 | 3/1995 | Rosenburgh et al. | 354/324 |
| 5,400,107 | 3/1995 | Rosenburgh et al. | 354/336 |

FOREIGN PATENT DOCUMENTS

| | | | |
|---|---|---|---|
| 314124 | 5/1989 | European Pat. Off. . | |
| 424820 | 5/1991 | European Pat. Off. . | |
| 0559026A1 | 2/1993 | European Pat. Off. . | |
| 0581197A2 | 7/1993 | European Pat. Off. . | |
| 559025 | 9/1993 | European Pat. Off. . | |
| 559026 | 9/1993 | European Pat. Off. . | |
| 559027 | 9/1993 | European Pat. Off. . | |
| 559028 | 9/1993 | European Pat. Off. . | |
| 559029 | 9/1993 | European Pat. Off. . | |
| 2622708 | 5/1989 | France | 354/322 |
| 2932595 | 2/1981 | Germany | 354/324 |
| 55-79446 | 6/1980 | Japan . | |
| 1-114843 | 5/1989 | Japan . | |
| 2-18559 | 1/1990 | Japan . | |
| 2-52343 | 2/1990 | Japan | 354/324 |
| 4-86660 | 3/1992 | Japan | 354/324 |
| 1397977 | 6/1975 | United Kingdom | 354/325 |
| 89/04508 | 5/1989 | WIPO . | |
| 90/08979 | 1/1990 | WIPO . | |
| 91-17482 | 11/1991 | WIPO | 354/324 |
| 91/19226 | 12/1991 | WIPO . | |
| 0524414A1 | 6/1992 | WIPO . | |
| 93/00612 | 1/1993 | WIPO . | |

*Primary Examiner*—Glenn A. Caldarola
*Assistant Examiner*—J. Pasterczyk
*Attorney, Agent, or Firm*—J. Lanny Tucker

[57] ABSTRACT

A method of processing an imagewise exposed black and white silver halide photographic element comprising developing and desilvering the photographic element in a low volume thin tank processor wherein the processor operates at 15% or less of maximum production capacity.

20 Claims, No Drawings

METHOD OF PROCESSING BLACK AND WHITE PHOTOGRAPHIC ELEMENTS USING PROCESSORS HAVING LOW VOLUME THIN TANK DESIGNS

CROSS REFERENCE TO RELATED APPLICATIONS

This is a continuation-in-part of application Ser. No. 08/221,711, filed Mar. 31, 1994 by Carli, Foster, Gates, Patton, Rosenburgh and Vincent now U.S. Pat. No. 5,436, 118.

FIELD OF THE INVENTION

This invention relates to the processing of black and white silver halide photographic materials. It more specifically relates to the processing of such materials using a Low Volume Thin Tank processing system.

BACKGROUND OF THE INVENTION

Photographic processing equipment and processing chemicals continue to evolve to meet the increasing demand for convenient, low cost, and environmentally friendly photoprocessing. Some of the recent changes have included improved processing chemicals which provide faster processing for both film and paper, and smaller, more streamlined equipment which requires a reduced amount of photochemicals. One popular system is a minilab which is conveniently sized for typical production demands and which can conveniently process a roll of film and provide prints in a short time. In addition to processing consumer black and white film and paper, similar demands for convenience, low cost and environmentally friendly photoprocessing are needed for the processing of graphic arts films, aerial imaging products, microfilm, and medical imaging products (X-ray films).

However, even the advent of the minilab has not addressed all the needs and problems of modern photoprocessing. Two areas which particularly need addressing are 1) the increasing demand for photoprocessing capabilities in non-traditional photoprocessing environments and 2) the need to reduce the amount of replenishment necessary to keep a photoprocess system stable, both to decrease cost and to reduce the amount of effluent from processing machines. These two areas are often interrelated. In addition there is the never-ending desire to reduce processing time and/or the amount of chemicals needed to fully process various photographic materials.

The demand for non-traditional photoprocessing environments is also being fueled by the increase of digital image processing. As digital image processing becomes more prevalent, there is a growing need for hard copy from digital sources. Silver halide photographic hard copy can give the highest quality images, but is often found to be less convenient than electrophotographic or thermal technologies. Since the photographic processing of digital images would often be done in an office, home, or other non-traditional photoprocessing environments, the convenience of processing is of upmost importance.

Currently available processors can be inconvenient for home or office processing or for other small operations for the following reasons. First, the volume of the tank solutions that need to be prepared to fill a processor are still somewhat large for small-scale operations. Typical processor tank volumes of 10 to 25 liters for processor tanks require relatively large volumes of solutions to be handled.

Secondly, for low utilized systems, the processing solutions remain in the tank for a long residence time. The lack of 'tank-turnovers' with fresh replenisher causes the solutions to evaporate and the components to oxidize, causing the chemical concentrations of the components to change. This leads to process control variability and precipitate or tar formation, both of which can affect sensitometry. Such low utilization problems are one of the largest obstacles for small-scale operations when using traditional processing equipment.

The need to reduce the amount of replenishment is driven by both cost and environmental concerns and is shared by large and small processors. This is especially difficult for disposal of waste for home, office or other small-scale operations. Photographic processors are equipped with replenisher solutions designed to maintain process activity at a steady-state, as sensitized goods are processed. The replenishers contain the necessary components to replace chemicals consumed or lost through oxidation or carryover in developing, fixing and washing and/or stabilization of sensitized materials.

In automated systems, as sensitized materials are processed, a signal is relayed to turn on the replenisher pumps, so that fresh solution is added to the process tanks. The rates that the solutions are added to the process are dependent on the concentration of components which can be attained in the replenisher solutions.

The replenishment rate in a processing system is set at the lowest rate possible. This reduces the effluent from the process, lowers handling of chemicals, reduces the amount of chemicals used, and reduces the energy needed to maintain operating temperatures. However, the amount replenishment can be reduced is dependent on the following factors.

1. Replenisher Stability—Once all components are combined into a single solution, the components begin reacting with each other and with oxygen, limiting the usefulness of the solution to the stability of the components. The usefulness of a mixed replenisher is normally 4–8 weeks, but may be as short as a few days. Solution stability may be enhanced by the use of covers which sit on top of the solution, eliminating air space which allows oxidation and evaporation.
2. Concentrate Stability—Because of the reactivity of the various components with each other and with oxygen, it is necessary to separate the replenisher concentrates into two or more parts until they are to be used. Concentrates are normally stable for several years if properly stored.
3. Productivity—The quantity of sensitized material processed daily is of concern, since low replenishment rates cause the tank solutions to be resident in the tanks for longer periods of time, subjecting them to oxidation, evaporation and interaction degradation.
4. Carryover—Carryover is the solution carried over from one tank into the next with the sensitized materials. The lower the carryover, the more stable the solutions. When very little or no solution is carried over into the next tank, less dilution occurs and less replenisher is needed in the next tank and less chemical interaction degradation takes place. If the carryover is high, more solution is carried over and more replenisher is needed to compensate for dilution and chemical interaction degradation. If the carryover out of the tank is greater than the replenishment rate, the tank volume will decrease. This results in a loss in the process activity due to the resulting volume loss. This loss reduces the time the sensitized material is in the solution and could lead to processor malfunction. If tank volume is lost, processing solution must be added to maintain solution level.

5. Evaporation-Oxidation—Evaporation and oxidation take place constantly with all processors. To control them, the area of solution exposed to the air needs be kept to a minimum. A surface which results in considerable evaporation and oxidation is the surface of rollers which are used to transport the sensitized material from one tank to another. Some processors have rollers which are partially submerged in the process solutions. The continual wetting and drying of these rollers increases evaporation and oxidation of the processing solutions. It is advantageous to have rollers either completely submerged or completely out of solution. Another way to reduce evaporation and oxidation is to reduce the flow of air over the solutions.
6. Tank turnover—Tank turnover (TTO) is the time required to replace the process tank solution with fresh replenisher solution. Reducing the replenishment rate of solutions extends the residence time of the solutions in the processor, increasing the time per tank turnover. To reduce the time per TTO and replenishment rate, it is necessary to reduce the volume of the processor tanks or increase the utilization (productivity) of the processor. Reducing the volume of the tanks or increasing the utilization of the processor, will decrease the time per tank turnover and reduce the residence time of the solutions. The operator of the process may not be able to increase the utilization of the processor depending on the production demands. There is often a seasonal nature to the processor utilization with periods of low utilization occurring in production demand cycles.
7. Precipitation/Crystallization—Components which are present in the tank solutions may increase in concentration due to seasoning (processing of sensitized materials) or because of evaporation. Because of their solubility, the components may precipitate or crystallize from solution, or form a tar-like phase separation. The increase of the level of certain components may cause the precipitation or crystallization or tar formation of other components by reducing their solubility. The lower the replenishment rate, the more likely that this will occur.
8. Process by-product buildup—Materials washing out of the sensitized product, such as, sensitizing dyes, halides, calcium, silver, which accumulate in the solutions as they season out of the sensitized materials, or as they are formed from reactions during photoprocessing, may also precipitate, crystallize, or form tar-like deposits. This effect is more significant if an attempt is made to reuse or regenerate the waste solutions so that they can be used in the processor again.
9. Pump accuracy—As the replenishment rates are reduced, the need for high accuracy, low-volume pumps becomes imperative.

In particular, the amount of replenishment necessary is dependent on the level of utilization of the processor. When a traditional processing system has low utilization it cannot be operated using a low replenishment regime because the system is not stable.

The industry has attempted to compensate for low utilization problems and disposal problems by adjusting processing chemistry. For example, minilab film and paper processors run through a wide range of utilizations. One unit may experience a wide change of utilizations depending on the time of the year and production demands. A variety of processor chemical solutions can be made available to accommodate most situations by adding more preservative or to formulate for a higher replenishment rate.

Most minilab processors have been designed to operate "plumbless" (no water connections needed for washing of the prints or drains needed to dispose of effluents). To achieve a plumbless processor, it was necessary to design a wash system which allowed for the reduction of wash-water volume. This is accomplished with a stabilizer which stabilizes the solution, prevents processing by-products from being deposited on the prints or the tank walls, and incorporates a biocide to prevent biogrowth in solutions. The processors have been designed with countercurrent replenishment, with each tank of solution recirculated and heated.

However, all of the above options involve the need to purchase and use different processing solutions or make other accommodating actions for varying utilization conditions, a situation that can be inconvenient or confusing to the user. For example, the developer regenerators, while very effective at reducing effluent, involve additional equipment and operating steps which may be inconvenient for small-scale operations. Further, none of the above solutions are stable at very low utilization.

Current technology is reaching its limits with regard to size and processing capability. Problems of the small-scale operation such as low utilization, tank size, and processing cost cannot be fully addressed with alterations to existing equipment. Additionally, the ability to significantly reduce replenishment rates below current standards with existing equipment and chemistry no longer exists. Further, traditional systems have been maximized with regard to processing parameters. There is little flexibility left to reduce processing time or chemical consumption.

SUMMARY OF THE INVENTION

This invention provides a method of processing an imagewise exposed black and white silver halide photographic element comprising developing and desilvering the black and white photographic element in a low volume thin tank processor wherein the processor operates at 15% or less of maximum production capacity.

It further provides a method of processing an imagewise exposed black and white silver halide photographic element comprising developing the silver halide element in a developing solution, in a low volume thin tank processor, wherein the developing solution is replenished by direct replenishment. It also provides a method of processing an imagewise exposed silver halide photographic element comprising desilvering the photographic element in a fixing solution, in a low volume thin tank processor, wherein the fixing solution is replenished by direct replenishment.

The processor of this invention has a Low Volume Thin Tank (LVTT) processor having either a "rack and tank" or "automatic tray" design that are more fully described hereafter. This processor may be utilized with all standard black and white films and papers sensitized to be exposed via digital means and/or by conventional optical exposure, including graphic arts films, X-ray and other medical imaging films, aerial photographic films, microfilms and other films used by professional, government, scientific, commercial and amateur photographers. The processor may be utilized with all standard black and white film and paper chemistries, or variations on such chemistries designed to take full advantage of the LVTT concept.

This invention provides consistent, high quality film processing and prints from digital and/or optical sources. The improved chemical reaction rates from the high-impingement agitation rack design allows additional flexibility in the processing system which can be taken as 1) reduced process time, 2) reduced process temperature, 3) reduced chemical concentrations, or 4) any combination of points 1 to 3. The increased process activity also allows for further replenishment rate reductions and lower chemical waste volume due to greater processing efficiency. LVTT technology, with its high agitation, would also be expected to enable prints to be washed more efficiently in a shorter period of time.

The LVTT technology of this invention further provides a small compact processor which is convenient for use in a small space. LVTT technology, with its significant volume reduction, reduces the time needed to warm the solutions to operating temperature. A processor with 18 liter tanks takes 45 minutes to an hour to come to operating temperature, whereas an LVTT processor takes 15–20 minutes. The cost to dump the chemical solutions from an LVTT system is greatly reduced because of lower volumes to be discarded and less downtime (i.e. time required to drain, remix and reheat to temperature). A system dump and restart which normally takes 4–6 hours, now will take only 1–2 hours. The energy to maintain a processor during low utilization times is lower, both to maintain the operating temperature, and on standby mode.

The reduction in tank volume reduces the chemicals needed to start up the processor. Further, it allows significant reductions in area of the solution exposed to air resulting in reduced loss caused by oxidation and evaporation. The reduced effects of oxidation and evaporation help to maintain stability in a system which has a low utilization rate.

The low tank volume and reduced oxidation and evaporation also allows for low replenishment rates. It particularly allows direct replenishment of concentrated solutions and water. The use of concentrated solutions eliminates operator labor by eliminating the need to mix replenishers and also minimizes operator contact with process solutions.

Other advantages of a direct replenishment system in combination with an LVTT system are as follows: 1) the replenishers are not prepared, so the stability of replenishers is not an issue, 2) the concentrates may be placed into special containers and need not be removed for mixing the concentrates, thereby maintaining their integrity, 3) the reduced volumes eliminates the need for high productivity to give acceptable solution stability, 4) the use of concentrates eliminates the concern of oxidation of replenishers, 5) with the reduced volume and the reduced evaporation and oxidation resulting from LVTT, the time per tank turnover (TTO) is decreased and direct replenishment technology is enhanced, making low utilization less of an issue, and 6) even with direct replenishment of concentrated solutions, the reduced residency time of solutions in the tanks reduces the chances of precipitates, crystals, or tar formation and reduces the chances of byproduct buildup which can have an adverse effect on process solutions.

This system also provides improved developability and speed/fog relationships in the photographic material. The improved developability of the high-agitation LVTT results from the increased rate of development resulting from the more effective refreshment of developer reactants and removal of by-products that form as a result of the development reaction. While this effect would be readily observed with emulsions that have a grain size in the range of from 0.10 to 1.0 μm in edge length, the improvement with LVTT should be even more noticeable and beneficial with larger grain size emulsions in the range of from 1.0 to 2.0 μm in edge length. While these emulsions are typically cubic, the morphology could cover a broad range of forms.

The LVTT can improve the speed/fog relationship because the LVTT processor can decrease the time needed to reach maximum density in the sensitized material.

It is known that as the sensitivity (emulsion speed) of a given silver halide is increased through formulation changes that eventually an increase in the minimum density region is observed that is independent of exposure. Formulation changes that can increase speed include chemicals for sensitization, speed-enhancing addenda, and formulation procedures in any speed-enhancing sensitization step and would include time and temperature increases as examples. The amount of silver halide sensitivity achieved is limited by the amount of minimum density increase (fog) that can be tolerated.

An LVTT processor decreases the time needed to reach maximum density because of the increased process activity. Therefore the LVTT in combination with various silver halide sensitizations can result in formulations of higher sensitivity without a penalty for high minimum density (fog). This could be found to be the case with many different developer formulations in a variety of applications.

DETAILED DESCRIPTION OF THE INVENTION

The processors utilized with this invention are Low Volume Thin Tank processors. A Low Volume Thin Tank processor provides a small volume for holding the processing solution. As a part of limiting the volume of the processing solution, a narrow processing channel is provided. The processing channel, for a processor used for black and white photographic paper, should have a thickness equal to or less than about 50 times the thickness of the paper being processed, preferably a thickness equal to or less than about 10 times the paper thickness. In a processor for processing black and white photographic film, the thickness of the processing channel should be equal to or less than about 100 times the thickness of photosensitive film, preferably, equal to or less than about 18 times the thickness of the photographic film. An example of a low volume thin tank processor which processes paper having a thickness of about 0.02 cm would have a channel thickness of about 0.2 cm and a processor which processes film having a thickness of about 0.014 cm would have a channel thickness of about 0.25 cm.

The total volume of the processing solution within the processing channel and recirculation system is relatively smaller as compared to prior art processors. In particular, the total amount of processing solution in the entire processing system for a particular module is such that the total volume in the processing channel is at least 40 percent of the total volume of processing solution in the system. Preferably, the volume of the processing channel is at least about 50 percent of the total volume of the processing solution in the system.

Typically the amount of processing solution available in the system will vary on the size of the processor, that is, the amount of photosensitive material the processor is capable of processing. For example, a typical prior art microlab paper processor, a processor that processes from about 0.09 $m^2$/min to about 0.46 $m^2$/min of photosensitive material (which generally has a transport speed less than about 203 cm per minute) has about 17 liters of processing solution as compared to about 5 liters for a low volume thin tank processor. With respect to typical prior art minilabs, a paper processor that processes from about 0.46 $m^2$/min. to about 1.4 $m^2$/min. of photosensitive material (which generally has a transport speed less than about 203 cm/min. to about 381 cm/min.) has about 100 liters of processing solution as compared to about 10 liters for a low volume processor. Large prior art lab paper processors that process up to 8.3 $m^2$/min. of photosensitive material (which generally have transport speeds of about 2.1 to 21 m/min.) typically have from about 120 to 1,200 liters of processing solution as compared to a range of about 15 to 100 liters for a low volume large processor. A minilab size low volume thin tank processor made in accordance with the present invention designed to process 1.4 $m^2$ of photosensitive material per minute would have about 7 liters of processing solution. Similar examples can be described for film processors.

Preferably the system is a high impingement system, such as described hereafter. In order to provide efficient flow of the processing solution through the nozzles into the processing channel, it is desirable that the nozzles/opening that deliver the processing solution to the processing channel have a configuration in accordance with the following relationship:

$$1 \leqq F/A \leqq 40$$

wherein:

F is the flow rate of the solution through the nozzle in gallons per minute; and A is the cross-sectional area of the nozzle provided in square inches.

This relationship, in metric terms, is:

$$0.59 \leqq F/A \leqq 24$$

wherein F is the flow rate of the solution through the nozzle in liters per minute, and A is the cross-sectional area of the nozzle provided in square centimeters.

Providing a nozzle in accordance with the foregoing relationship assures appropriate discharge of the processing solution against the photosensitive material. In the case of processing X-ray films, the narrow channel advantageously contains at least two nozzles, preferably, one on each side of the processed film.

Specific embodiments of an LVTT processor are described in detail in the following documents, incorporated herein by reference. These documents describe both the "rack and tank" and "automatic tray" designs of LVTT processors. The "rack and tank" design generally has a vertical processing channel whereas the "automatic tray" design generally has a horizontal processing channel. Other designs utilizing the narrow processing channel and nozzles described above would be readily apparent to one skilled in the art.

| Title | Pub. No. or Appln. No. | Pub. or Filing Date |
|---|---|---|
| PHOTOGRAPHIC PROCESSING APPARATUS | WO 92/10790 | 25JUN92 |
| PHOTOGRAPHIC PROCESSING APPARATUS | WO 92/17819 | 15OCT92 |
| PORTABLE FILM | WO 93/04404 | 03MAR93 |

-continued

| Title | Pub. No. or Appln. No. | Pub. or Filing Date |
|---|---|---|
| PROCESSING UNIT | | |
| CLOSURE ELEMENT | WO 92/17370 | 15OCT92 |
| PHOTOGRAPHIC PROCESSING TANK | WO 91/19226 | 12DEC91 |
| METHOD AND APPARATUS FOR PHOTOGRAPHIC PROCESSING | WO 91/12567 | 22AUG91 |
| PHOTOGRAPHIC PROCESSING APPARATUS | WO 92/07302 | 30APR92 |
| PHOTOGRAPHIC PROCESSING APPARATUS | WO 93/00612 | 07JAN93 |
| PHOTOGRAPHIC PROCESSING APPARATUS | WO 92/07301 | 30APR92 |
| PHOTOGRAPHIC PROCESSING APPARATUS | WO 92/09932 | 11JUN92 |
| PROCESS RACK INTEGRAL WITH PUMPS | U.S. Pat. No. 5,294,956 | 15MAR94 |
| A DRIVING MECHANISM FOR A PHOTOGRAPHIC PROCESSING APPARATUS | EP 559,027 or U.S. Pat. No. 5,311,235 | 08SEP93 |
| ANTI-WEB ADHERING CONTOUR SURFACE FOR A PHOTOGRAPHIC PROCESSING APPARATUS | U.S. Pat. No. 5,179,404 | 12JAN93 |
| A RACK AND A TANK FOR A PHOTOGRAPHIC PROCESSING APPARATUS | EP 559,025 | 08SEP93 |
| A SLOT IMPINGEMENT FOR A PHOTOGRAPHIC PROCESSING APPARATUS | U.S. Pat. No. 5,270,762 | 14DEC93 |
| RECIRCULATION, REPLENISHMENT, REFRESH, RECHARGE AND BACK-FLUSH FOR A PHOTOGRAPHIC PROCESSING APPARATUS | EP 559,026 | 08SEP93 |
| AUTOMATIC TRAY PROCESSOR | USSN 08/057,250, now U.S. Pat. No. 5,353,088 | 03MAY93 |
| | USSN 08/209,582, now U.S. Pat. No. 5,400,106 | 10MAR94 |
| MODULAR PROCESSING CHANNEL FOR AN AUTOMATIC TRAY PROCESSOR | USSN 08/056,458, now U.S. Pat. No. 5,420,658 | 03MAY93 |
| | USSN 08/209,756, now U.S. Pat. No. 5,420,659 | 10MAR94 |
| COUNTER CROSS FLOW FOR AN AUTOMATIC TRAY PROCESSOR | USSN 08/056,447, now U.S. Pat. No. 5,313,243 | 03MAY93 |
| | USSN 08/209,180 now U.S. Pat. No. 5,418,591 | 10MAR94 |
| VERTICAL AND HORIZONTAL POSITIONING AND COUPLING OF AUTOMATIC TRAY PROCESSOR CELLS | USSN 08/057,131, now U.S. Pat. No. 209,754 | 03MAY93 |
| | USSN 08/209,754 now U.S. Pat. No. 5,386,261 | 10MAR94 |
| TEXTURED SURFACE WITH CANTED CHANNELS FOR AN AUTOMATIC TRAY PROCESSOR | USSN 08/056,451, now U.S. Pat. No. 5,353,086 | 03MAY93 |
| | USSN 08/209,093, now U.S. Pat. No. 5,381,203 | 10MAR94 |

-continued

| Title | Pub. No. or Appln. No. | Pub. or Filing Date |
|---|---|---|
| AUTOMATIC REPLENISHMENT, CALIBRATION AND METERING SYSTEM FOR AN AUTOMATIC TRAY PROCESSOR | USSN 08/056,730, now U.S. Pat. No. 5,353,087 | 03MAY93 |
| | USSN 08/209,758, now U.S. Pat. No. 5,400,107 | 10MAR94 |
| CLOSED SOLUTION RECIRCULATION/SHUTOFF SYSTEM FOR AN AUTOMATIC TRAY PROCESSOR | USSN 08/056,457, now U.S. Pat. No. 5,353,083 | 03MAY93 |
| | USSN 08/209,179, now U.S. Pat. No. 5,387.994 | 10MAR94 |
| A SLOT IMPINGEMENT FOR AN AUTOMATIC TRAY PROCESSOR | USSN 08/056,649, now U.S. Pat. No. 5,355,190 | 03MAY91 |
| | USSN 08/209,755, now U.S. Pat. No. 5,398,094 | 10MAR94 |
| A RACK AND A TANK FOR A PHOTOGRAPHIC LOW VOLUME THIN TANK INSERT FOR A RACK AND A TANK PHOTOGRAPHIC PROCESSING APPARATUS | USSN 08/020,311 now U.S. Pat. No. 5,452,043 | 19FEB93 |
| AUTOMATIC REPLENISHMENT, CALIBRATION AND METERING FOR A PHOTOGRAPHIC PROCESSING | USSN 08/056,455, now U.S. Pat. No. 5,339,131 | 03MAY93 |

The processors of this invention are particularly useful in low-utilization conditions. Low utilization is defined as a percentage of maximum production capacity. Current processors, particularly minilabs, often do not operate at or near their maximum production capacity. A processor maximum production capacity is simply the maximum number of rolls or prints that can be processed in a given time frame. This is usually based on 24 prints from a 35 mm photographic element. When a processor is being operated at a small percentage of its maximum capacity, low-utilization effects due to evaporation and oxidation of chemical components occur causing the process to give less than optimum results or go out of acceptable performance. Low utilization is when a processor is operating at less than 15% of maximum production capacity, and particularly at less than 10% maximum production capacity. For example, a roller transport processor operating at less than 15% maximum production capacity is operating under low utilization conditions.

The LVTT processing system is particularly useful with direct replenishment. In an LVTT processor the chemistry does not become unstable at the very low replenishment rate possible with direct replenishment. This is not true for standard processors when they are operated under low utilization conditions.

Direct replenishment is the replenishment of concentrated solutions directly into the process tanks, without the need to prepare replenisher solutions. Each concentrate is added separately and mixed in the processor using high accuracy pumps.

Whether replenishers or regenerators, the concentrates are made available as multiple parts because of the incompatibility of the components at the high concentrations and over a long period of time. Each part of the concentrate contains process solution components at or near their solubility level.

Use of such direct replenishment with an LVTT processor allows for a developer replenishment rate of 108 ml/m$^2$ or less, more preferably 65 ml/m$^2$ or less, and most preferably 43 ml/m$^2$ or less for black and white paper. It further allows for a fixer replenishment rate of 108 ml/m$^2$ or less, more preferably 54 ml/m$^2$ or less, and most preferably 22 ml/m$^2$ or less for black and white paper. For film it allows a developer replenishment rate of 20 ml/roll or less, and more preferably 15 ml/roll or less. It further allows for replenishment rate of 35 ml/roll or less, and more preferably 30 ml/roll or less, and a stabilizer replenishment rate of 40 ml/roll or less, and more preferably 30 ml/roll or less (a roll is 35mm-24 exposure having a surface area of 0.42 ft$^2$ or 0.039 m$^2$ per roll).

The development time may be up to 6 minutes, with 10 to 180 seconds being preferred and 15 to 135 seconds being more preferred. The development temperature may be in the range of from about 20 to about 50° C. with a preferred range being from 25 to 45° C., and a most preferred range being from 30 to 40° C.

The photographic elements to be processed can contain any of the conventional silver halides as the photosensitive material, for example, silver chloride, silver bromide, silver bromoiodide, silver chlorobromide, silver chloroiodide, and mixtures thereof. Preferably, however, the photographic element contains at least one silver halide emulsion. The preferred silver content of the black and white photographic papers or films is less than about 5 g/m$^2$ and more preferably, less than about 4 g/m$^2$. In the case of X-ray films, the amount is generally less than about 3.5 g/m$^2$ on each side of the support and preferably, less than about 3 g/m$^2$ on each side of the support.

The materials of the invention can be used with black and white photographic elements in any of the ways and in any of the combinations known in the art. Typically, photographic materials are incorporated in a silver halide emulsion and the emulsion coated as a layer on a support to form part of a photographic element.

In the following discussion of suitable materials for use in the emulsions and elements that can be used in conjunction with elements of this invention, reference will be made to *Research Disclosure*, December 1989, Item 308119, and February, 1995, Item 37038, both published by Kenneth Mason Publications, Ltd., Dudley Annex, 12a North Street, Emsworth, Hampshire P010 7DQ, ENGLAND, which will be identified hereafter by the term "*Research Disclosure*." The contents of the *Research Disclosure*, including the patents and publications referenced therein, are incorporated herein by reference, and the Sections hereafter referred to are Sections of the first mentioned *Research Disclosure* publication.

The silver halide emulsions employed can be either negative-working or positive-working. Suitable emulsions and their preparation as well as methods of chemical and spectral sensitization are described in Sections I through IV. Vehicles are described in Section IX, and various additives such as brighteners, antifoggants, stabilizers, light absorbing and scattering materials, hardeners, coating aids, surfactants, plasticizers, lubricants and matting agents are described, for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

The invention materials may also be used in association with materials that accelerate or otherwise modify the processing steps e.g. fixing to improve the quality of the image.

Also contemplated is use of the compositions in association with nucleating agents, development accelerators or their precursors (UK Patent 2,097,140 and U.K. Patent 2,131,188), electron transfer agents (U.S. Pat. Nos. 4,859,578 and 4,912,025), antifogging agents such as derivatives of hydroquinones, benzotriazole derivatives, phenylmercaptotetrazole and derivatives, aminophenols, amines, gallic acid, catechol, ascorbic acid, hydrazides, sulfonamidophenols, and noncolor-forming couplers.

The aqueous phase of the dispersions of the photographic elements used in conjunction with elements of the invention may comprise a hydrophilic colloid. This may be gelatin or a modified gelatin such as acetylated gelatin, phthalated gelatin, oxidized gelatin, etc. The hydrophilic colloid may be another water-soluble polymer or copolymer including, but not limited to poly (vinyl alcohol), partially hydrolyzed poly (vinylacetate/vinylalcohol), hydroxyethyl cellulose, poly-(acrylic acid), poly(1-vinylpyrrolidone), poly(sodium styrene sulfonate), poly(2-acrylamido-2-methane sulfonic acid), and polyacrylamide. Copolymers of these polymers with hydrophobic monomers may also be used.

The emulsions of the photographic elements can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The shape of the silver halide emulsion grain can be cubic, pseudo-cubic, octahedral, tetradecahedral or tabular. The emulsions may be precipitated in any suitable environment such as a ripening environment, or a reducing environment. Specific references relating to the preparation of emulsions of differing halide ratios and morphologies are Evans U.S. Pat. No. 3,618,622; Atwell U.S. Pat. No. 4,269,927; Wey U.S. Pat. No. 4,414,306; Maskasky U.S. Pat. No. 4,400,463, Maskasky U.S. Pat. No. 4,713,323; Tufano et al U.S. Pat. No. 4,804,621; Takada et al U.S. Pat. No. 4,738,398; Nishikawa et al U.S. Pat. No. 4,952,491; Ishiguro et al U.S. Pat. No. 4,493,508, Hasebe et al U.S. Pat. No. 4,820,624; Maskasky U.S. Pat. No. 5,264,337; and Brust et al EP 534,395.

Especially useful for use in conjunction with elements of this invention are tabular grain silver halide emulsions. Specifically contemplated tabular grain emulsions are those in which greater than 50 percent of the total projected area of the emulsion grains are accounted for by tabular grains having a thickness of less than 0.3 μm (0.5 μm for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in μm and t is the average thickness in μm of the tabular grains.

The average useful ECD of photographic emulsions can range up to about 10 μm, although in practice emulsion ECD's seldom exceed about 4 μm. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 μm) tabular grains. To achieve the lowest levels of granularity it is preferred that aim tabular grain projected areas be satisfied with ultrathin (t<0.06 μm) tabular grains. Tabular grain thicknesses typically range down to about 0.02 μm. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 μm. Ultrathin tabular grain high chloride emulsions are disclosed by Maskasky in U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: *Research Disclosure*, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616. In addition, use of [100] silver chloride emulsions as described in EP 534,395 are specifically contemplated.

Dopants (any grain occlusions other than silver and halide ions) can be employed to modify grain structure and properties. When dopant metals are present during precipitation in the form of coordination complexes, particularly tetra- and hexa-coordination complexes, both the metal ion and the coordination ligands can be occluded within the grains. Coordination ligands, such as halo, aquo, cyano, cyanate, fulminate, thiocyanate, selenocyanate, nitrosyl, thionitrosyl, oxo, carbonyl and ethylenediamine tetraacetic acid (EDTA) ligands have been disclosed and, in some instances, observed to modify emulsion properties.

Dopants can be added in conjunction with addenda, antifoggants, dye, and stabilizers either during precipitation of the grains or post precipitation, possibly with halide ion addition. These methods may result in dopant deposits near or in a slightly subsurface fashion, possibly with modified emulsion effects.

Desensitizing or contrast increasing ions or complexes are typically dopants which function to trap photogenerated holes or electrons by introducing additional energy levels deep within the bandgap of the host material. Examples include, but are not limited to, simple salts and complexes of Groups 8–10 transition metals (e.g., rhodium, iridium, cobalt, ruthenium, and osmium), and transition metal complexes containing nitrosyl or thionitrosyl ligands.

Shallow electron trapping ions or complexes are dopants which introduce additional net positive charge on a lattice site of the host grain, and which also fail to introduce an additional empty or partially occupied energy level deep within the bandgap of the host grain. For the case of a six coordinate transition metal dopant complex, substitution into the host grain involves omission from the crystal structure of a silver ion and six adjacent halide ions (collectively referred to as the seven vacancy ions). The seven vacancy ions exhibit a net charge of −5. A six coordinate dopant complex with a net charge more positive than −5 will introduce a net positive charge onto the local lattice site and can function as a shallow electron trap. The presence of additional positive charge acts as a scattering center through the Coulomb force, thereby altering the kinetics of latent image formation.

If desired, the photographic element can be used in conjunction with an applied magnetic recording layer as described in *Research Disclosure*, November 1992, Item 34390.

Any suitable base material may be utilized for the black and white papers or films. Typically, base materials are formed of paper or polyester. The paper may be resin-coated. Further, the paper base material may be coated with reflective materials that will make the image appear brighter to the viewer such as polyethylene impregnated with titanium dioxide. In addition, the paper or resins may contain stabilizers, tints, sizing agents, stiffeners or oxygen barrier providing materials such as polyvinyl alcohol (PVA, for example, see EP 553,339). In addition, it may be desired to use the invention in conjunction with a photographic element coated on pH adjusted support as described in U.S. Pat. No. 4,917,994. The particular base material utilized in the invention may be any material conventionally used in silver halide color or black and white papers. Such materials are disclosed in *Research Disclosure* 308119, December 1989, page 1009. Additionally materials like polyethylene naphthalate and the materials described in U.S. Pat. Nos. 4,770,931; 4,942,005; and 5,156,905 may be used.

Photographic elements can be exposed to actinic radiation, typically in the visible region of the spectrum, to form a latent image and can then be processed to form a visible image. Processing to form a visible image includes the step of contacting the element with a developing agent to reduce developable silver halide.

In development, silver halide that has been exposed to light is reduced to silver. In this process halide ions from the silver halide grains are dissolved into the developer, where they will accumulate. In a batch-processing method, the performance of the developer solution will eventually be degraded as a result of the halide ion build-up and the consumption of developer components. Therefore, in a development method that continuously processes a large amount of a silver halide photographic light-sensitive material, for example by automatic-developing processors, in order to avoid a change in the finished photographic characteristics caused by the change in the concentrations of the components, some means is required to keep the concentrations of the components of the developer within certain ranges.

For instance, a developer solution in a processor tank can be maintained at a 'steady-state concentration' by the use of another solution that is called the replenisher solution. By metering the replenisher solution into the tank at a rate proportional to the amount of the photographic light-sensitive material being developed, components can be maintained at an equilibrium within a concentration range that will give good performance. For the components that are consumed, such as the developing agents and preservatives, the replenisher solution is prepared with the component at a concentration higher than the tank concentration. In some cases a material will leave the emulsion layers that will have an effect of restraining development, and will be present at a lower concentration in the replenisher or not present at all. In other cases a material may be contained in a replenisher in order to remove the influence of a materials that will wash out of the photographic light-sensitive material. In other cases, for example, the buffer, or the concentration of a chelating agent where there may be no consumption, the component in the replenisher is the same or similar concentration as in the processor tank. Typically the replenisher has a higher pH to account for the acid that is released during development so that the tank pH can be maintained at an optimum value.

Similarly, replenishers are also designed for the fixing solutions. In addition to additions for components that are consumed, components are added to compensate for the dilution of the tank which occurs when the previous solution is carried into the tank by the photographic light-sensitive material.

As previously described, a developer processing tank in a continuous processor is replenished with a replenisher solution to maintain the correct concentration of developer solution components. The developer replenisher solution may be replenished in an amount of, ordinarily not more than 500 ml/m$^2$ of a light sensitive material. Since replenishment results in a quantity of waste solution, the rate of replenishment is preferably minimized so that waste volume and costs can be minimized. A preferred replenishment rate is within a range of 10 to 215 ml/m$^2$, and more preferably 25 to 160 ml/m$^2$.

Additionally the developer waste volume and material costs may be reduced by recovering the overflow from the developer tank as it is being replenished and treating the overflow solution in a manner so that the overflow solution can be used again as a replenisher solution. In one operating mode, chemicals are added to the overflow solution to make up for the loss of chemicals from that tank solution that resulted from the consumption of chemicals that occurred during the development reactions. The chemicals can be added as solid components or as aqueous solutions of the component chemicals. Addition of water and the aqueous solutions of the make-up chemicals also have the effect to reduce the concentration of the materials that wash out of the light-sensitive material and are present in the developer overflow. This dilution of materials that wash out of the light-sensitive material prevents concentration of these materials from increasing to concentrations that can lead to undesired photographic effects, reduced solution stability, and precipitates. If the materials that wash out of the light-sensitive material are found to increase to an objectionable concentration, the overflow solution can be treated to remove the objectionable material. Ion-exchange resins, cationic, anionic and amphoteric are especially well suited to remove specific components found to be objectionable.

Rather than use direct replenishment of concentrated solution, prior art developed reuse can be used. The recovery of developer solution overflow can be characterized as the percentage of the original replenisher solution that is recovered and reused, thus a 55% 'reuse ratio' indicates that of the original replenisher volume used, 55% of the original volume was recovered and reused. It may be necessary to treat the overflow solution to remove halide ion using prior art ion-exchange treatments. A packaged chemical mix of concentrated chemical solutions concentrates can be designed to be used with a designated amount of overflow to produce a replenisher solution for use in the continuous processor being used to process the light sensitive material. While it is useful to be able to recover any amount of developer overflow solution, it is preferable to be able to recover at least 50% (ie. a 50% reuse ratio) of the developer overflow. It is preferred to have a reuse ratio of 50% to 75% and it is more preferred to have a reuse ratio of 50% to 95%.

Black and white developer solutions can include a number of components including, but not limited to, developing agents, metal chelating agents, stain reducing agents, halides, acids or bases, and other compounds readily apparent to one skilled in the art.

Generally known black and white developing agents can be used in the practice of this invention, including but not limited to, polyhydroxybenzenes (such as hydroquinone, hydroquinone monosulfonate and catechol), p-aminophenols (such as metol) and pyrazolidones (such as phenidone, dimezone and hydroxymethylmethyl phenidone). They can be used in any useful concentration that would be readily apparent to one skilled in the art.

The components of a fixing solution are comprised of preservatives, fixing agents, chelating agents, acids, and bases. Each of the components may be used as single components or as mixtures of two or more components.

As fixing agents, thiosulfates, thiocyanates, thioether compounds, thioureas, and thioglycolic acid can be used. A preferred component is thiosulfate, and ammonium thiosulfate, in particular is used most commonly owing to the high solubility. If desired, other counter ions may be used in place of ammonium ion. Alternative counterions such as potassium, sodium, lithium, cesium as well as mixtures of two or more cations are mentioned and would have advantages to be able to eliminate ammonia from the waste volume. The concentration of these silver halide fixing agents is preferably between 0.1 and 3.0 mol/l and more preferably between 0.2 and 1.5 mol/l.

As preservatives, sulfites, bisulfites, metabisulfites, ascorbic acid, carbonyl-bisulfite adducts or sulfinic acid compounds are typically used. The use of sulfites, bisulfites, and metabisulfites are especially desirable. The concentration of preservatives is preferably present from zero to 0.5 mol/l and more preferably between 0.02 and 0.4 mol/l.

The pH value of the fixing solution is preferably in the range of about 3.0 to 8.0 and most preferably in the range of about 4.0 to 6.5. In order to adjust the pH value to the above mentioned range and to maintain good pH control, a weak organic acid with a pKa between 4 and 6, such as acetic acid, glycolic acid or malonic acid can be added in conjunction with an alkaline agent such as aqueous ammonia.

Water-soluble aluminum salts usable mainly as hardeners in the fixing solution are compounds generally known as hardeners in acidic hardening fixing solutions. They include, for example, aluminum chloride, aluminum sulfate and potash alum. Useful dibasic acids include tartaric acid and derivatives (tartaric acid, potassium tartrate, sodium tartrate, potassium sodium tartrate, ammonium tartrate and potassium ammonium tartrate) thereof and citric acid and derivatives thereof. These are usable alone or in admixture. These compounds are generally present in an amount of at least about 0.005 mol/l, and preferably at from about 0.01 to about 0.03 mol/l, of fixing solution.

In addition, mineral acids such as hydrochloric acid, nitric acid, sulfuric acid and phosphoric acid can normally be used for the acid component and these acids can be used as a mixture with one or more salt of the weak acids previously mentioned above in order to provide a buffering effect.

Brightening agents, defoaming agents, surfactants, fungicides, anti-corrosion agents and organic solvents, such as polyvinylpyrrolidone or methanol, as examples, may be added, if desired.

The fixing replenisher solution can be directly replenished to the fixing solution to maintain chemical concentrations and pH conditions adequate to completely remove the silver from the photographic light-sensitive material. The volume of replenishment solution added per square meter of photographic light-sensitive material can be considered to be a function of the amount of silver present in the photographic light-sensitive material. It is preferred to use low volumes of replenishment solution so low silver materials are preferred.

The fixing time may be about 10 to 240 seconds, with 40 to 60 seconds being a preferred range, and between 25 and 45 seconds being most preferred. The temperature of the fixing solution may be in the range from 20° to 50° C. with a preferred range between 25 and 40° C. and a most preferred range between 35° and 40° C.

The specific processing conditions for every step used in the method of this invention will depend upon the type of black and white element being processed, as is known in the art.

Fixing solution overflow can be reconstituted as described in U.S. Pat. No. 5,063,142 and European Patent Application No. 410,354 or U.S. Pat. No. 5,055,382.

The amount of the replenisher for the fixing solution is from 54 to 3240 ml/m$^2$, and preferably from 54 to 1300 ml/m$^2$ of the photographic light-sensitive material.

To minimize the volume of fixer solution that is needed to process the light-sensitive photographic material, the fixer solution can be recovered and treated to remove the silver from the solution by means of electrolysis, precipitation and filtration, metallic replacement with another metal, or ion-exchange treatment with a material that will remove the silver. The desilvered solution can then be reconstituted to return the chemical concentrations to the replenisher concentration to make up for the chemicals consumed during the fixing of the light-sensitive photographic material or during the silver recovery treatment process, or to compensate for the dilution of the constituents by the carryover of solution from the previous processing stage in the process. The treatment to return the chemical concentrations to the replenisher concentration can be accomplished by the addition of chemicals as solid materials or as concentrated solutions of the chemicals. The degree of recovery of fixer solution can be measured by comparing the volume of solution that can be recovered and reused as a percentage of the original volume that was used in the process. Thus a 90% reuse recovery ratio would occur when from an original 100 liters of replenisher volume 90 liters would be treated and recovered to produce 100 liters of regenerated fixer replenisher. The recovery reuse ratio of greater than 50% is preferred, greater than 75% is more preferred and greater than 90% is most preferred.

Preferably, following the fixer bath is a wash bath to remove chemicals from the processing solution before it is dried. Preferably the wash stage is accomplished with multiple stages to improve the efficiency of the washing action. The replenishment rate for the wash water is between 20 and 10,000 ml/m$^2$, preferably between 150 and 2000 ml/m$^2$. The solution can be recirculated with a pump and filtered with a filter material to improve the efficiency of washing and to remove any particulate matter that results in the wash tank. The temperature of the wash water is 20° to 50° C., preferably 30° to 40° C. To minimize the volume of water being used, the wash water that has been used to process the light-sensitive photographic material can be recovered and treated to remove chemical constituents that have washed out of the light-sensitive photographic material or that has been carried over from a previous solution by the light sensitive material. Common treatment procedures would include use of ion-exchange resins, precipitation and filtration of components, and distillation to recover purer water for reuse in the process.

In addition, salt solutions are known that can be used to reduce the amount of wash water needed in this method. One such salt solution is commercially available as KODAK Hypo Clearing Agent.

To minimize the amount of water that is used to wash the light sensitive material, a solution may be employed that uses a low-replenishment rate over the range of 20 to 2000 $ml/m^2$, preferably between 50 and 400 $ml/m^2$ and more preferably between 100 and 250 $ml/m^2$. When the replenishment rate is reduced, problems with precipitates and biogrowth may be encountered. To minimize these problems, agents can be added to control the growth of bio-organisms, for example 5-chloro-2-methyl-4-isothiazolin-3-one, 2-methyl-4-isothiazolin-3-one and 2-octyl-4-isothiazolin-3-one. To prevent precipitation formation preferable agents which may be added include polymers or copolymers having a pyrrolidone nucleus unit, with Poly-N-vinyl-2-pyrrolidone as a preferred example. Other agents which may be added include a chelating agent from the aminocarboxylate class of chelating agents such as those that were listed previously in the description of developer constituents; a hydroxyalkylidenediphosphonic acid, with 1-hydroylethylidene-1,1-diphosphonic acid being a preferred material; an organic solubilizing agent, such as ethylene glycol; stain-reducing agents such as those mentioned as stain reducing agents for the developer constituents; acids or bases to adjust the pH; and buffers to maintain the pH.

Antibacterial agents and antifungal agents include thiazolybenzimidazoles, isothiazolones, and chlorophenols such as trichlorophenol, bromophenols, organothin or organozinc compounds, thiocyanic or isothiocyanic acid compounds, acid amides, diazine or triazines, thioureas, benzotriazolealkylguanidines, quaternary ammonium salts such as benzammonium chloride, antibiotics such as penicillin and the antifungal agents described in *Journal of Antibacterial and Antifungal Agents*, Vol. 11, No. 5, 207–223 (1983).

The processing composition of the present invention is fundamentally composed of the foregoing development step and the subsequent fixing step. There can be one or more washing steps before, after or between those steps.

The relationship of the number of wash tanks and the amount of wash water in a multistage counter-current system can be obtained by the method described in *Journal of the Society of Motion Picture and Television Engineering*, Vol. 64, 248–253 (May 1955). In accordance with the multistage counter-current system described in the above publication, the amount of wash water can be greatly reduced.

In the wash step, a multistage counter-current system is preferably used and the number of stages is preferably from 2 to 4. The amount of replenisher is from 1 to 50 times, preferably from 2 to 30 times, and more preferably from 2 to 15 times the amount carried from the pre-bath per unit area.

The water for the wash step or the stabilization step may be tap water, but deionized water having calcium and magnesium ion concentrations of less than 5 mg/l with ion exchange resins and water sterilized with a halogen or an ultraviolet sterilizing lamp are preferably used. As water for replacing evaporated water, city water may be used, but preferred is deionized water or sterilized water which is preferably used for the wash step or the stabilization step.

The following examples are intended to illustrate but not limit the invention.

EXAMPLE 1

Processing of a Black and White Paper Using LVTT

A commercially available black and white photographic paper, KODAK Polycontrast III RC F was processed using commercially available KODAK POLYMAX RT Developer and Replenisher and Rapid Fixer in a LVTT processor. The standard processing conditions were used (that is, 15 seconds for development, 15 seconds for fixing, and 38° C.). The sensitometric results from white light exposures are listed in the following Table I.

TABLE I

| | |
|---|---|
| White light speed | 2.07 |
| White light shoulder | 0.478 |
| White light toe | 0.259 |
| White light Dmax | 2.23 |
| White light Dmin | 0.067 |
| Polymax 0 Filter (RCO) speed | 1.86 |
| Polymax 0 Filter (RCO) shoulder | 0.74 |
| Polymax 0 Filter (RCO) toe | 0.292 |
| Polymax 5+ Filter (RC5) speed | 1.35 |
| Polymax 5+ Filter (RC5) shoulder | 0.167 |
| Polymax 5+ Filter (RC5) toe | 0.162 |

EXAMPLE 2

Processing Black and White Photographic Films Using LVTT

Two different black and white films were processed using a LVTT processor in the following manner. Samples of the conventional black and white films KODAK T-MAX 400 Professional Film and KODAK TRI-X PAN Film were exposed using 21-step black and white exposure. They were then developed for 90 seconds using KODAK DURAFLO RT Developer Replenisher and KODAK DURAFLO RT Starter, fixed using 135 seconds using KODAK Rapid Fixer, and washed with water for 135 seconds in the LVTT. Development was carried out at four different temperatures.

The film samples were dried. Contrast in the film samples was measured as the conventional "contrast index (CI)". The results are shown below in Table II.

TABLE II

| Film Sample | Development Temperature | Contrast Index |
|---|---|---|
| KODAK T-MAX 400 | 27° C. | 0.55 |
| " | 32° C. | 0.91 |
| " | 38° C. | 1.21 |
| " | 43° C. | 1.29 |
| KODAK TRI-X PAN | 27° C. | 0.58 |
| " | 32° C. | 0.83 |
| " | 38° C. | 1.10 |
| " | 43° C. | 1.33 |

The invention has been described in detail with particular reference to preferred embodiments thereof, but it will be understood that variations and modifications can be effected within the spirit and scope of the invention.

We claim:

1. A method of processing an imagewise exposed black and white silver halide photographic element comprising developing and desilvering said black and white photographic element in a processor having either a rack and tank or automatic tray design, said processor comprising a narrow processing channel wherein said processor operates at 15% or less of maximum production capacity, said black and white photographic element being processed in said narrow processing channel of said processor, which narrow processing channel has a thickness equal to or less than 100 times the thickness of said photographic element being processed, the total amount of each processing solution used in said narrow processing channel being at least 40% of the total volume of said each processing solution in said processor, and said each processing solution is delivered to said narrow processing channel via at least one nozzle according to the following formula:

$$1 \leqq F/A \leqq 40$$

wherein F is the flow rate of said processing solution through said nozzle in gallons per minute, and A is the cross-sectional area of said nozzle in square inches.

2. The method of claim 1 wherein the processor operates at 10% or less of maximum production capacity.

3. The method of claim 1 wherein said black and white photographic element has a silver halide emulsion wherein greater than 90 mole % of the silver halide is silver chloride.

4. The method of claim 1 wherein said photographic element is a black and white photographic paper.

5. The method of claim 1 wherein said photographic element is an X-ray film having emulsion on both sides of a film support.

6. The method of claim 1 wherein said black and white silver halide photographic element has a silver bromoiodide emulsion.

7. The method of claim 1 wherein said black and white photographic element comprises a tabular grain silver halide emulsion.

8. The method of claim 1 for the processing of a black and white photographic paper, wherein said narrow processing channel has a thickness equal to or less than 50 times the thickness of said black and white photographic paper being processed.

9. The method of claim 1 for the processing of a black and white photographic film, wherein said narrow processing channel has a thickness equal to or less than 18 times the thickness of said black photographic film being processed.

10. A method of processing an imagewise exposed black and white silver halide photographic element comprising developing said black and white photographic element in a developing solution, in a processor having either a rack and tank or automatic tray design, said processor comprising a narrow processing channel wherein said developing solution is replenished by direct replenishment, said black and white photographic element being processed in said narrow processing channel of said processor, which narrow processing channel has a thickness equal to or less than 100 times the thickness of said black and white photographic element being processed, the total amount of said developing solution used in said narrow processing channel being at least 40% of the total volume of said developing solution in said processor, and said developing solution being delivered to said narrow processing channel via at least one nozzle according to the following formula:

$$1 \leqq F/A \leqq 40$$

wherein F is the flow rate of said developing solution through said nozzle in gallons per minute, and A is the cross-sectional area of said nozzle in square inches.

11. The method of claim 10 wherein said developing solution is replenished at the rate of 108 ml or less per $m^2$ of photographic element surface area.

12. The method of claim 11 wherein said developing solution is replenished at the rate of 65 ml or less per $m^2$ of photographic element surface area.

13. The method of claim 10 wherein said developing solution is replenished at the rate of 20 ml or less per roll of 35 mm-24 exposure film having a surface area of 0.039 $m^2$.

14. A method of processing an imagewise exposed black and white silver halide photographic element comprising desilvering said black and white photographic element in a fixing solution, in a processor having either a rack and tank or automatic tray design, said processor comprising a narrow processing channel wherein said fixing solution is replenished by direct replenishment, said black and white photographic element being processed in said narrow processing channel of said processor, which narrow processing channel has a thickness equal to or less than 100 times the thickness of said black and white photographic element being processed, the total amount of said fixing solution used in said narrow processing channel being at least 40% of the total volume of said fixing solution in said processor, and said fixing solution being delivered to said narrow processing channel via at least one nozzle according to the following formula:

$$1 \leqq F/A \leqq 40$$

wherein F is the flow rate of said fixing solution through said nozzle in gallons per minute, and A is the cross-sectional area of said nozzle in square inches.

15. The method of claim 14 wherein said fixing solution is replenished at the rate of 108 ml or less per $m^2$ of photographic element surface area.

16. The method of claim 15 wherein said fixing solution is replenished at the rate of 54 ml or less per $m^2$ of photographic element surface area.

17. The method of claim 14 wherein said photographic element has a silver halide emulsion wherein greater than 90 mole % of the silver halide is silver chloride.

18. The method of claim 14 wherein said photographic element is an X-ray film which is processed in said narrow processing channel wherein at least two of said nozzles are used to deliver said fixing solution to both sides of said X-ray film.

19. The method of claim 1 wherein said low volume thin tank processor further comprises transport rollers that are either completely submerged in or completely out of processing solution.

20. The method of claim 19 wherein said low volume thin tank processor further comprises transport rollers that are completely submerged in processing solution.

* * * * *